US009251936B2

(12) United States Patent
Smith et al.

(10) Patent No.: US 9,251,936 B2
(45) Date of Patent: Feb. 2, 2016

(54) RESISTOR AND METHOD FOR MAKING SAME

(71) Applicant: Vishay Dale Electronics, LLC, Columbus, NE (US)

(72) Inventors: Clark L. Smith, Columbus, NE (US); Thomas L. Bertsch, Norfolk, NE (US); Todd L. Wyatt, Columbus, NE (US); Thomas L. Veik, Columbus, NE (US); Rodney Brune, Columbus, NE (US)

(73) Assignee: Vishay Dale Electronics, LLC, Columbus, NE (US)

( * ) Notice: Subject to any disclaimer, the term of this patent is extended or adjusted under 35 U.S.C. 154(b) by 0 days.

(21) Appl. No.: 14/228,780

(22) Filed: Mar. 28, 2014

(65) Prior Publication Data

US 2014/0210587 A1 Jul. 31, 2014

Related U.S. Application Data

(60) Continuation of application No. 13/569,721, filed on Aug. 8, 2012, now Pat. No. 8,686,828, which is a division of application No. 12/205,197, filed on Sep. 5, 2008, now Pat. No. 8,242,878.

(51) Int. Cl.

| | |
|---|---|
| ***H01C 1/02*** | (2006.01) |
| ***H01C 1/142*** | (2006.01) |
| ***H01C 3/00*** | (2006.01) |

(Continued)

(52) U.S. Cl.

CPC ..... *H01C 1/142* (2013.01); *H01C 3/00* (2013.01); *H01C 17/003* (2013.01); *H01C 17/24* (2013.01); *H01C 17/288* (2013.10); *Y10T 29/49082* (2015.01); *Y10T 29/49098* (2015.01)

(58) Field of Classification Search

CPC ..... H01C 17/24; H01C 1/142; H01C 3/00; H01C 1/144; H01C 1/148; H01C 17/003; H01C 17/288

USPC ..... 338/327, 195

See application file for complete search history.

(56) References Cited

U.S. PATENT DOCUMENTS

| | | | |
|---|---|---|---|
| 4,780,702 | A | 10/1988 | Snel et al. |
| 4,830,723 | A | 5/1989 | Galvagni et al. |

(Continued)

FOREIGN PATENT DOCUMENTS

| | | | |
|---|---|---|---|
| CN | 1930641 | A | 3/2007 |
| EP | 1 901 314 | A1 | 3/2008 |

(Continued)

*Primary Examiner* — Kyung Lee

(74) *Attorney, Agent, or Firm* — Volpe and Koenig, P.C.

(57) ABSTRACT

A metal strip resistor is provided. The metal strip resistor includes a metal strip forming a resistive element and providing support for the metal strip resistor without use of a separate substrate. There are first and second opposite terminations overlaying the metal strip. There is plating on each of the first and second opposite terminations. There is also an insulating material overlaying the metal strip between the first and second opposite terminations. A method for forming a metal strip resistor wherein a metal strip provides support for the metal strip resistor without use of a separate substrate is provided. The method includes coating an insulative material to the metal strip, applying a lithographic process to form a conductive pattern overlaying the resistive material wherein the conductive pattern includes first and second opposite terminations, electroplating the conductive pattern, and adjusting resistance of the metal strip.

20 Claims, 7 Drawing Sheets

(51) Int. Cl.

| | |
|---|---|
| ***H01C 17/24*** | (2006.01) |
| ***H01C 17/00*** | (2006.01) |
| ***H01C 17/28*** | (2006.01) |

(56) References Cited

U.S. PATENT DOCUMENTS

| | | | |
|---|---|---|---|
| 5,287,083 | A | 2/1994 | Person et al. |
| 5,604,477 | A | 2/1997 | Rainer et al. |
| 6,401,329 | B1 | 6/2002 | Smejkal et al. |
| 7,129,814 | B2 | 10/2006 | Tsukada |
| 7,326,999 | B2 | 2/2008 | Tsukada |
| 7,327,214 | B2 | 2/2008 | Tsukada |
| 7,330,099 | B2 | 2/2008 | Tsukada |
| 7,667,568 | B2 | 2/2010 | Tanimura et al. |
| 2002/0180000 | A1 | 12/2002 | Juang et al. |
| 2005/0035844 | A1 | 2/2005 | Tsukada |
| 2005/0046543 | A1 | 3/2005 | Hetzler |
| 2005/0200451 | A1 | 9/2005 | Tsukada |
| 2006/0205171 | A1 | 9/2006 | Tsukada |
| 2008/0142923 | A1 | 6/2008 | Tischler |

FOREIGN PATENT DOCUMENTS

| | | | |
|---|---|---|---|
| JP | H0620803 | A | 1/1994 |
| JP | 2000-195707 | A | 7/2000 |
| JP | 2003-045703 | A | 2/2003 |
| JP | 2004-327906 | A | 11/2004 |
| JP | 2007-049071 | A | 2/2007 |
| JP | 2007-189123 | A | 7/2007 |
| JP | 2007-329421 | A | 12/2007 |
| TW | 200834817 | A | 8/2008 |
| WO | 01/46966 | A1 | 6/2001 |

RESISTOR AND METHOD FOR MAKING SAME

CROSS REFERENCE TO RELATED APPLICATION

This application is a continuation of U.S. patent application Ser. No. 13/569,721, filed Aug. 8, 2012, issuing as U.S. Pat. No. 8,686,828 on Apr. 1, 2014, which is a divisional of U.S. patent application Ser. No. 12/205,197, filed Sep. 5, 2008, now U.S. Pat. No. 8,242,878, issued Aug. 14, 2012, which are all incorporated by reference in their entireties as if fully set forth herein.

BACKGROUND

The present invention relates to low resistance value metal strip resistors and a method of making the same.

Metal strip resistors have previously been constructed in various ways. For example, U.S. Pat. No. 5,287,083 to Person et al. discloses plating nickel to the resistive material. However, such a process places limitations on the size of the resulting metal strip resistor. The nickel plating method is limited to large sizes because of the method for determining plating geometry. In addition, the nickel plating method has limitations on resistance measurement at laser trimming.

Another approach has been to weld copper strips to the resistive material to form terminations. Such a method is disclosed in U.S. Pat. No. 5,604,477 to Rainer et al. The welding method is limited to larger size resistors because the weld dimensions take up space.

Yet another approach has been to clad copper to the resistive material to form terminations such as disclosed in U.S. Pat. No. 6,401,329 to Smjekal et al. The cladding method is limited to larger size resistors because of tolerances in the skiving process used to remove copper material thus defining the width and position of the active resistor element.

Still further approaches are described in U.S. Pat. No. 7,327,214 to Tsukada, U.S. Pat. No. 7,330,099 to Tsukada, and U.S. Pat. No. 7,326,999 to Tsukada. Such approaches also have limitations.

Thus, all of the methods described have one or more limitations. What is needed is a small sized low resistance value metal strip resistor and a method for making it.

SUMMARY

Therefore, it is a primary object, feature, or advantage of the present invention to improve over the state of the art and to provide a small sized low resistance value metal strip resistor and a method for making it.

According to one aspect of the present invention, a metal strip resistor is provided. The metal strip resistor includes a metal strip forming a resistive element and providing support for the metal strip resistor without use of a separate substrate. There are first and second opposite terminations overlaying the metal strip. There is plating on each of the first and second opposite terminations. There is also an insulating material overlaying the metal strip between the first and second opposite terminations.

According to another aspect of the present invention, a metal strip resistor is provided. The metal strip resistor includes a metal strip forming a resistive element and providing support for the metal strip resistor without use of a separate substrate. There are first and second opposite terminations sputtered directly to the metal strip. There is plating on each of the first and second opposite terminations. There is also an insulating material overlaying the metal strip between the first and second opposite terminations.

According to yet another aspect of the present invention, a metal strip resistor is provided. The resistor includes a metal strip forming a resistive element and providing support for the metal strip resistor without use of a separate substrate. There is an adhesion layer sputtered to the metal strip. There are first and second opposite terminations sputtered to the adhesion layer. There is plating on each of the first and second opposite terminations and an insulating material overlaying the metal strip between the first and second opposite terminations.

According to another aspect of the present invention, a method for forming a metal strip resistor wherein a metal strip provides support for the metal strip resistor without use of a separate substrate is provided. The method includes coating an insulative material to the metal strip, applying a photolithographic process to form a conductive pattern overlaying the resistive material wherein the conductive pattern includes first and second opposite terminations, electroplating the conductive pattern, and adjusting resistance of the metal strip.

According to another aspect of the present invention, a method for forming a metal strip resistor wherein a metal strip provides support for the metal strip resistor without use of a separate substrate is provided. The method includes mating a mask to the metal strip to cover portions of the metal strip, sputtering an adhesion layer to the metal strip, the mask preventing the adhesion layer from depositing on the portions of the metal strip covered by the mask, the portions of the metal strip covered by the mask forming a pattern including first and second opposite terminations. The method further includes coating an insulative material to the metal strip and adjusting resistance of the metal strip.

DETAILED DESCRIPTION OF THE PREFERRED EMBODIMENTS

The present invention relates to metal strip resistors and a method of making metal strip resistors. The method is suitable for making an 0402 size or smaller, low ohmic value, metal strip surface mount resistor. An 0402 size is a standard electronics package size for certain passive components with 0.04 inch by 0.02 inch (1.0 mm by 0.5 mm) dimensions. One example of a smaller size of packaging which also may be used is an 0201 size. In the context of the present invention, a low ohmic value is generally a value suitable for applications in power-related applications. A low ohmic value is generally one that is less than or equal to 3 Ohms, but often times in the range of 1 to 1000 milliohms.

The method of manufacturing the metal strip resistor uses a process wherein the terminations of a resistor are formed by adding copper to the resistive material through sputtering and plating. This method utilizes photolithographic masking techniques that allow much smaller and better defined termination features. This method also allows the use of the much thinner resistance materials that are needed for the highest values in very small resistors yet, the resistor does not use a support substrate.

Figure 1:
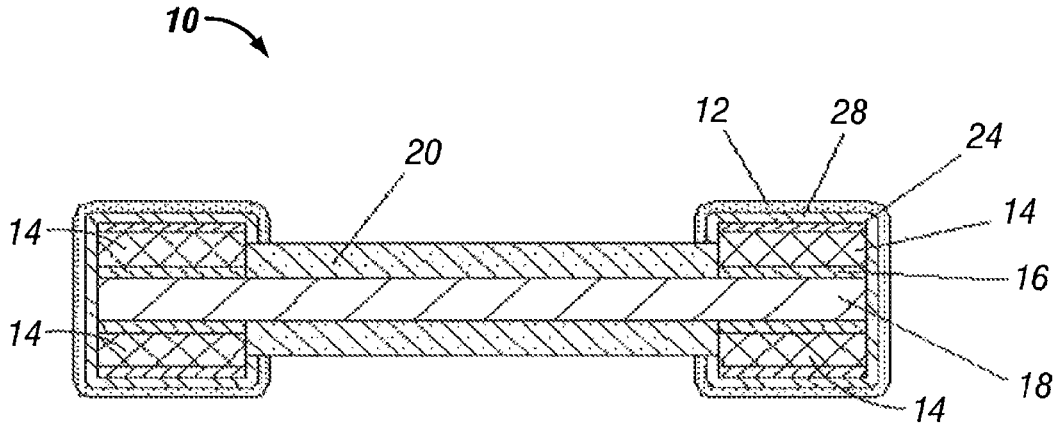
FIG. 1 is a cross-sectional view of one embodiment of a resistor.

FIG. 1 is a cross-sectional view of one embodiment of a metal strip resistor of the present invention. A metal strip resistor 10 is formed from a thin sheet of resistance material 18 such as, but not limited to EVANOHM (nickel-chromium-aluminum-copper alloy), MANGANIN (a copper-manganese-nickel alloy), or other type of resistive material. The thickness of the resistance material 18 may vary based on desired resistance. However, the resistance material may be relatively thin if desired. Note that the resistance material 18 is central to the resistor 10 and provides support for the resistor 10 and there is no separate substrate present.

The resistor 10 shown in FIG. 1 also includes an optional adhesion layer 16 which may be formed of CuTiW (copper, titanium, tungsten). The adhesion layer 16, where used, is sputtered over the surface of the resistive material 18 for the copper plating 14 to bond to. Some resistance materials may require the use of the adhesion layer 16 and others do not. Whether the adhesion layer 16 is used, depends on the resistance material's alloy and if it allows direct bonding of copper plating with adequate adhesion. If an adhesion layer 16 is desirable and both sides of the resistance material 18 are to receive pads then both sides of the resistance material 18 should be sputtered with an adhesion layer 16.

Prior to the sputtering process a metal mask (not shown in FIG. 1) may be mated with the sheet of resistance material 18 to prevent the CuTiW material from depositing onto areas of the sheet that will later become the active resistor areas. This mechanical masking step allows one to eliminate a gold plating and etch back step later in the process thus reducing cost. Where gold plating is used, or other highly conductive plating, the gold plating 24 overlays the copper plating 14. A plating 28 is provided which may be a nickel plating. A tin plating 12 overlays the nickel plating 28 to provide for solderability.

Also shown in FIG. 1 is an insulative coating material 20 which is applied to the resistance material 18. The insulative coating material 20 is preferably a silicone polyester with high operating temperature resistance. Other types of insulating materials may be used which are chemical resistant and capable of handling high temperature.

Figure 2:
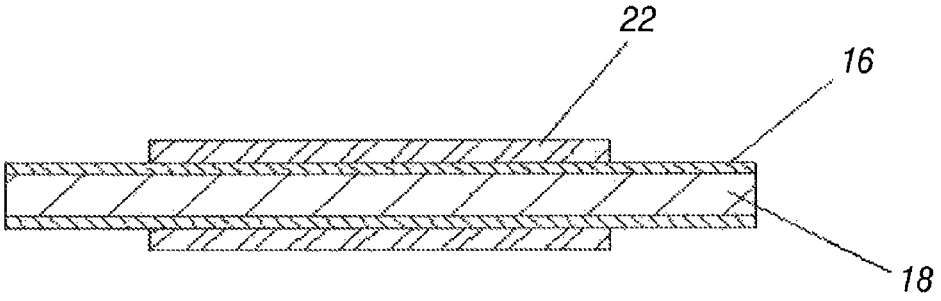
FIG. 2 is a cross-sectional view of a resistance material with an adhesion layer and a mask during the manufacturing process.

FIG. 2 illustrates a relatively thin sheet of resistance material such as EVANOHM, MANGANIN or other type of resistance material 18. The resistance material 18 serves as the substrate and support structure for the resistor. There is no separate substrate present. The thickness of this sheet of resistance material 18 may be selected to achieve higher or lower resistance value ranges. A field layer of CuTiW (copper, titanium, tungsten) or other suitable material is sputtered over the surface of the resistive material 18 as an adhesion layer 16 for the copper plating to bond to. Prior to the sputtering process, a metal mask may be mated with the sheet of resistance material 18 to prevent the CuTiW material or other material for the adhesion layer 16 from depositing onto areas of the sheet that will later become the active resistor areas. This mechanical masking step eliminates a gold plating and etch back step later in the process thus reducing cost.

Next a photolithographic process is performed. The photolithographic process may include laminating a dry photoresist film 22 to both sides of the resistance material 18 to protect the resistance material 18 from copper plating. A photo mask may then be used to expose the photoresist with a pattern corresponding to the copper areas to be deposited onto the resistance material. The photoresist 22 is then developed, exposing the resistive material in only the areas where copper or other conductive material is to be deposited as shown in FIG. 2.

Figure 3:
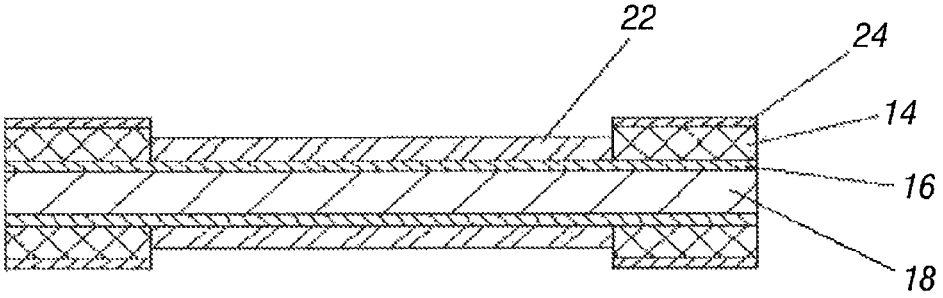
FIG. 3 is a cross-sectional view after applying a conductive pattern and electroplating during the manufacturing process.
Figure 4:
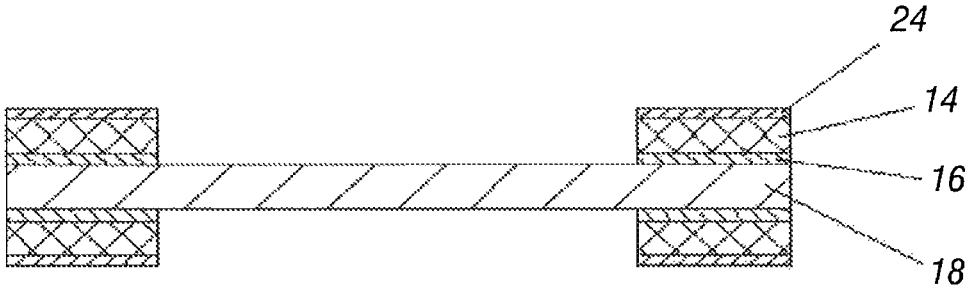
FIG. 4 is a cross-sectional view after stripping material away during the manufacturing process.

FIG. 3 illustrates the copper pattern 14. The copper pattern may include individual terminal pads, stripes, or near complete coverage except in areas that will be the active resistor area. The pad size may be defined at the punching operation in cases where stripes and near-full coverage patterns are used. The terminal pad geometry and number can vary depending on the PCB mounting requirements and electrical connections required such as 2-wire or 4-wire circuit schemes, or multi-resistor arrays. Copper 14 is plated in an electrolytic process. A thin layer of Au (gold) 24 is electroplated over the copper. The photoresist material is then stripped as shown in FIG. 4 and subsequently the CuTiW material 16 not covered by copper plating 14 is stripped from the active resistor areas in a chemical etch process. In another embodiment the gold layer 24 is not added and the CuTiW layer 16 is not stripped back after removing the photoresist layer to save manufacturing cost but at the expense of electrical characteristics. In a further embodiment the gold is not added and stripping is not necessary because the CuTiW material was mechanically masked at the sputtering step.

Figure 5:
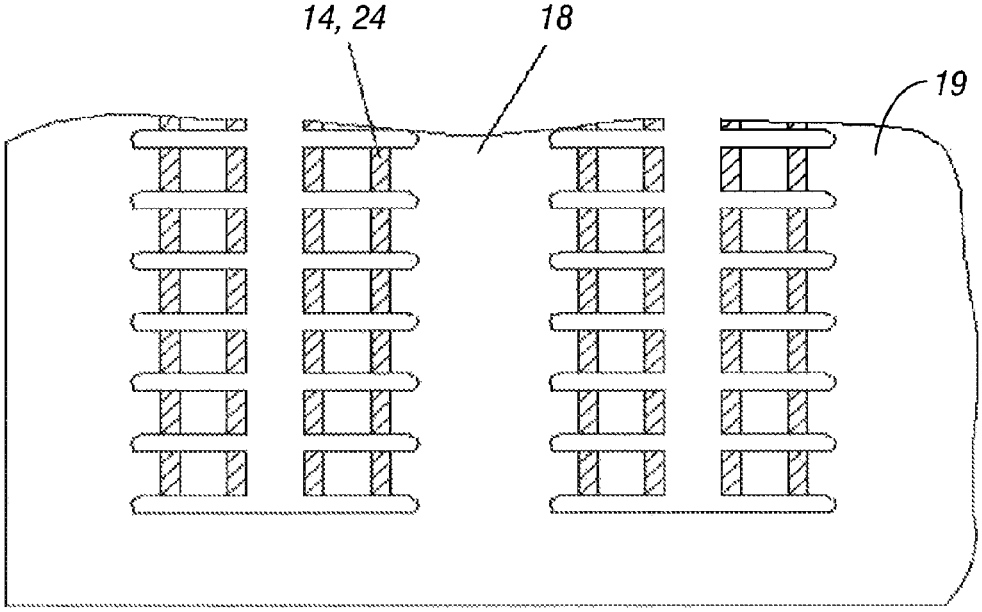
FIG. 5 is a top view of a resistive sheet during the manufacturing process.

The resulting terminated plate may be processed as a sheet, sections of a sheet, or in strips of one or two rows of resistors. The sheet process will be described from this point on but these subsequent processes also apply to sections and strips. As shown in FIG. 5, the sheet 19 is a continuous solid (although alignment holes may be present) and areas of the sheet 19 may then be removed to define the resistor's design dimensions of length and width. Preferably this is done with a punch tool but may also be done by a chemical etching process or by laser machining or mechanical cutting away of the unwanted material.

Figure 6:
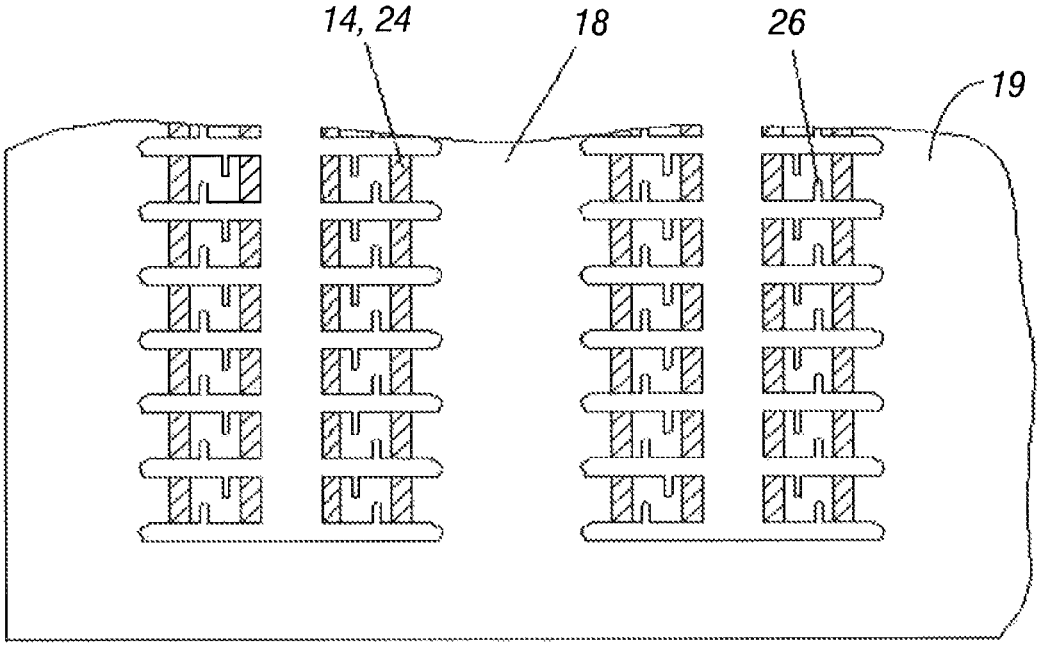
FIG. 6 is a top view of the resistive sheet during the manufacturing process after resistance has been adjusted.

The resistance values of the unadjusted resistors are determined by the copper pad spacing, defined by the photo mask, length, width, and the thickness of the sheet of resistive material. As shown in FIG. 6, adjustment of the resistance value may be accomplished by a laser or other means of removing material 26 to increase the resistance while at the same time measuring the resistance value. Adjustment of the resistance value may also be accomplished by adding more termination material, or other conductive material, in areas where the resistive material is still exposed to reduce the value. The resistors work equally as well with no material removed or added but the resistance value tolerance is much broader.

Figure 7:
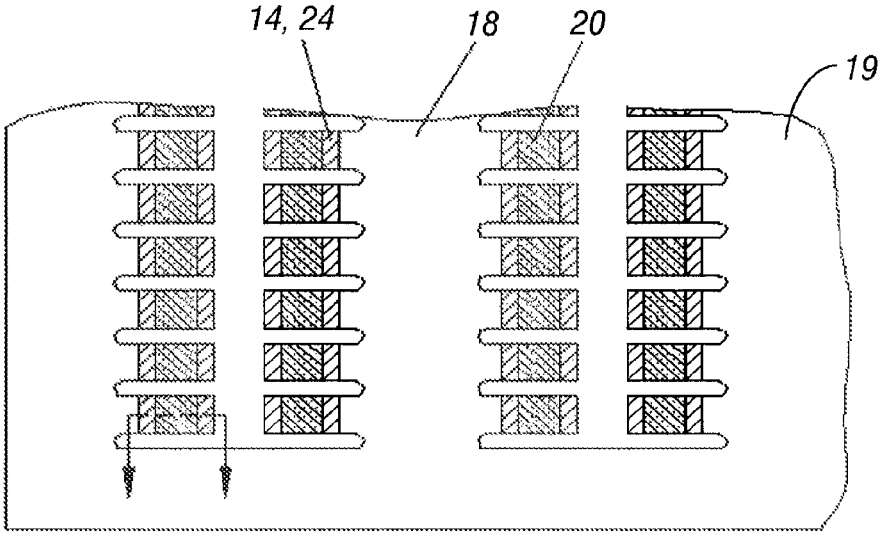
FIG. 7 is a top view of the resistive sheet during the manufacturing process where insulating material covers exposed resistor material between terminators.
Figure 8:
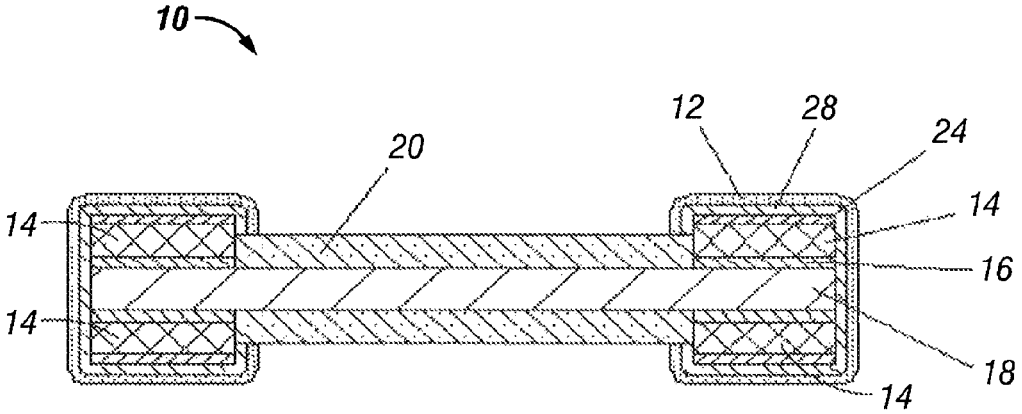
FIG. 8 is a cross-sectional view of a resistor after the plating process.
Figure 9:
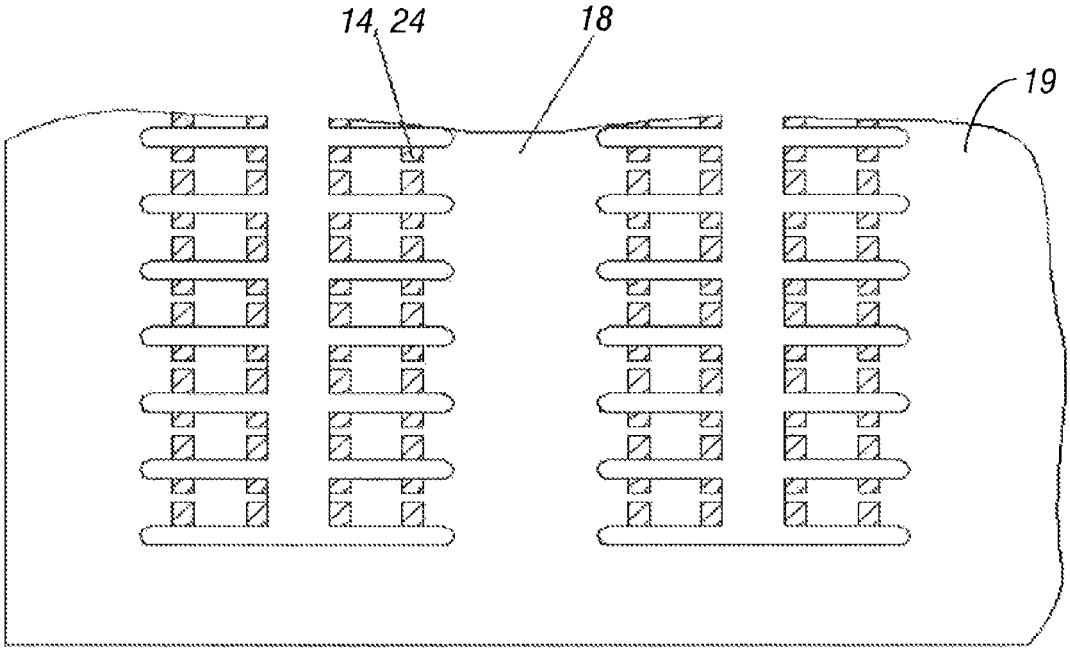
FIG. 9 is a top view of the resistive sheet showing four-terminal resistors.

As shown in FIG. 7 and FIG. 8, exposed resistor material between the terminations is covered by a coating material 20 which is an insulating material to prevent electroplating onto the resistive element and changing its resistance value. The coating material 20 is preferably a silicone polyester with high operating temperature resistance but may be other insulating materials that are chemical resistant and capable of handling high temperatures. The coating material 20 is preferably applied by a transfer blade. A controlled amount of coating material 20 is deposited on the edge of the blade and then transferred to the resistor by contact between the blade and resistor. Other methods of applying the coating material 20 may be used such as screen printing, roller contact transfer, ink jetting, and others. The coating material 20 is then cured by baking the resistors in an oven. Any markings that are put on the coating material 20 would be applied by ink transfer and baking or by laser methods at this point in the process. A die cutter may be used to remove each single resistor from the carrier plate. Other methods to singulate the resistors from the carrier may be used such as a laser cutter or photoresist mask and chemical etching.

Individual resistors are then put into a plating process where nickel 28 and tin 12 are added to make the part solderable to a PCB as shown in FIG. 1. Other plating materials may be used for other mounting methods such as gold for bonding applications. DC resistance may be checked on each piece and those in tolerance are placed into product packaging, usually tape and reel, for shipment.

Therefore a low resistor value material strip resistor has been disclosed. The resistor may achieve a small size, including an 0402 size or smaller package. The present invention contemplates numerous variations including variations in the materials used, whether an adhesion layer is used, whether the resistor is 2 terminal or 4 terminal, the specific resistance of the resistor, and other variations. In addition a process for forming a low resistance value metal strip resistor has also been disclosed. The present invention contemplates numerous variations, options and alternatives, including the manner in which a coating material is used, whether or not a mechanical masking step is used, and other variations.

What is claimed is:

1. A metal strip resistor, comprising:
- a metal strip forming a resistive element and providing support for the metal strip resistor without use of a separate substrate;
- first and second photolithographically formed terminations overlaying the metal strip; and
- an adhesion layer between each of the first and second photolithographically formed terminations and the metal strip.

2. The metal strip resistor of claim 1, further comprising an insulating material overlaying the metal strip between the first and second terminations.

3. The metal strip resistor of claim 2 wherein the insulating material comprises a polyimide.

4. The metal strip resistor of claim 2 wherein the insulating material is on both a top side of the metal strip and an opposite bottom side of the metal strip.

5. The metal strip resistor of claim 4 wherein the first and second terminations are on the top side of the metal strip and further comprise a pair of terminations on the bottom side of the metal strip.

6. The metal strip resistor of claim 1 wherein the metal strip is a metal alloy comprising at least one of nickel, chromium, aluminum, manganese, and copper.

7. The metal strip resistor of claim 1 wherein the adhesion layer comprises copper, titanium, and tungsten.

8. The metal strip resistor of claim 1 wherein the metal strip resistor is an 0402 size (1.0 mm by 0.5 mm) chip resistor.

9. The metal strip resistor of claim 1 further comprising plating on each of the first and second terminations.

10. A method for forming a metal strip resistor wherein a metal strip provides support for the metal strip resistor without use of a separate substrate, the method comprising:
- applying an adhesion layer to the metal strip;
- coating a photolithographic film onto the metal strip and adhesion layer;
- applying a photolithographic process to form a conductive pattern in the photolithographic film defining first and second terminations; and
- electroplating the conductive pattern.

11. The method of claim 10, further comprising adjusting resistance of the metal strip.

12. The method of claim 11 wherein the adjusting resistance is performed by removing material from the metal strip, using at least one of: a laser, a punch tool, or a chemical etching process.

13. The method of claim 11 further comprising singulating the metal strip resistor.

14. The method of claim 10 wherein the adhesion layer comprises copper, titanium, and tungsten.

15. The method of claim 10 wherein coating the photolithographic film onto the metal strip comprises coating the photolithographic film to a first side of the metal strip and coating the photolithographic film to a second side of the metal strip and wherein the photolithographic process is applied to both the first side and the second side to form a four terminal resistor.

16. The method of claim 10 wherein the electroplating the conductive pattern includes electroplating the conductive pattern with gold.

17. The method of claim 10 further comprising applying an insulating material overlaying the metal strip between the first and second terminations, wherein the insulating material is comprised of a silicone polyester.

18. The method of claim 10 wherein the insulating material is applied using a blade.

19. The method of claim 10 wherein the conductive pattern comprises copper.

20. The method of claim 10 further comprising the step of plating the first and second terminations.

* * * * *